US007661245B2

(12) United States Patent
Brown

(10) Patent No.: US 7,661,245 B2
(45) Date of Patent: Feb. 16, 2010

(54) CAPPING DEVICE WITH BEARING MECHANISM HAVING A PLURALITY OF BEARING MEMBERS BETWEEN A DRIVE MEMBER AND A CAPPER BODY

(75) Inventor: Michael J. Brown, Baltimore, MD (US)

(73) Assignee: ADCOR Industries, Inc., Baltimore, MD (US)

( * ) Notice: Subject to any disclaimer, the term of this patent is extended or adjusted under 35 U.S.C. 154(b) by 50 days.

(21) Appl. No.: 12/030,157

(22) Filed: Feb. 12, 2008

(65) Prior Publication Data

US 2008/0127611 A1 Jun. 5, 2008

Related U.S. Application Data

(63) Continuation-in-part of application No. 11/538,722, filed on Oct. 4, 2006, now Pat. No. 7,331,157.

(60) Provisional application No. 60/723,390, filed on Oct. 4, 2005.

(51) Int. Cl.
*B67C 3/20* (2006.01)

(52) U.S. Cl. ..... 53/317; 53/331.5

(58) Field of Classification Search ..... 53/317, 53/331.5, 490; 384/26, 42, 49; *B67B 3/20*
See application file for complete search history.

(56) References Cited

U.S. PATENT DOCUMENTS 3,303,633 A 2/1967 Wilhere
3,357,755 A * 12/1967 Danly ..... 384/49
3,435,587 A 4/1969 Weller
4,178,733 A 12/1979 Dankert
4,254,603 A 3/1981 Obrist
4,295,320 A 10/1981 Willingham
4,357,787 A 11/1982 Long
4,492,068 A * 1/1985 Obrist ..... 53/331.5
4,559,760 A 12/1985 Daniels et al.
4,635,662 A 1/1987 Totten
4,662,153 A 5/1987 Wozniak
4,720,197 A * 1/1988 Scharting et al. ..... 384/49

(Continued)

FOREIGN PATENT DOCUMENTS

JP 07232798 A * 9/1995

(Continued)

OTHER PUBLICATIONS

European Search Report dated Dec. 18, 2006; Application No. 06020817.0-1261; Applicant Adcor Industries, Inc.

*Primary Examiner*—Stephen F Gerrity
(74) *Attorney, Agent, or Firm*—Howard & Howard Attorneys PLLC

(57) ABSTRACT

A capping device fits caps onto containers by applying an axial force to the caps as they are threaded onto the containers. The capping device utilizes a drive member rotatable about an operational axis for imparting rotation to a capper body slidably coupled to the drive member. A helical spring urges the capper body away from the drive member with a biasing force. A bearing mechanism allows relative free sliding movement of the capper body relative to the drive member. The bearing mechanism includes a plurality of bearing members. In one embodiment, the bearing members are bushings. In another embodiment, the bearing members are ball bearings.

8 Claims, 9 Drawing Sheets

U.S. PATENT DOCUMENTS

| | | | | | |
|---|---|---|---|---|---|
| 4,906,147 | A | | 3/1990 | Friesinger et al. | |
| 5,140,866 | A | * | 8/1992 | Schetter et al. | 384/49 |
| 5,327,697 | A | | 7/1994 | Kent | |
| 5,490,369 | A | * | 2/1996 | Ellis et al. | 53/317 |
| 5,533,608 | A | | 7/1996 | Adams et al. | |
| 5,623,806 | A | | 4/1997 | Larson et al. | |
| 5,671,585 | A | | 9/1997 | Peronek et al. | |
| 5,687,552 | A | * | 11/1997 | Barca | 53/490 |
| 5,689,932 | A | | 11/1997 | Peronek et al. | |
| 5,884,450 | A | | 3/1999 | Ronchi | |
| 6,112,949 | A | | 9/2000 | Rhodes et al. | |
| 6,115,992 | A | * | 9/2000 | Bankuty et al. | 53/317 |
| 6,158,196 | A | | 12/2000 | Trebbi et al. | |
| 6,170,232 | B1 | | 1/2001 | VandeGeijn | |
| 6,240,678 | B1 | | 6/2001 | Spether | |
| 6,296,726 | B1 | * | 10/2001 | Pencak | 156/64 |
| 6,508,046 | B1 | | 1/2003 | Resterhouse et al. | |
| 6,543,204 | B2 | | 4/2003 | Gruson | |
| 6,840,024 | B2 | | 1/2005 | Ronchi | |
| 6,945,011 | B2 | | 9/2005 | Hidding et al. | |
| 7,331,157 | B2 | * | 2/2008 | Brown | 53/331.5 |
| 7,434,370 | B1 | * | 10/2008 | Scott et al. | 53/331.5 |
| 2002/0184853 | A1 | | 12/2002 | Arrant et al. | |
| 2004/0065049 | A1 | * | 4/2004 | Cirio | 53/317 |

FOREIGN PATENT DOCUMENTS

| | | |
|---|---|---|
| WO | 0002810 | 1/2000 |

* cited by examiner

CAPPING DEVICE WITH BEARING MECHANISM HAVING A PLURALITY OF BEARING MEMBERS BETWEEN A DRIVE MEMBER AND A CAPPER BODY

RELATED APPLICATIONS

This application is a continuation-in-part of U.S. patent application Ser. No. 11/538,722, filed Oct. 4, 2006, now U.S. Pat. No. 7,331,157, which claims the benefit of U.S. Provisional Patent Application No. 60/723,390, filed on Oct 4, 2005, the advantages and disclosure of both applications are hereby incorporated by reference.

FIELD OF THE INVENTION

The present invention generally relates to a capping device for fitting pre-threaded caps onto containers, particularly beverage containers. More specifically, the present invention relates to the capping device having a bearing mechanism for allowing relatively free sliding movement between a drive member, which rotates the capping device, and a capper body, which rotates with the drive member and applies the caps onto the containers.

BACKGROUND OF THE INVENTION

Capping machines typically utilize multiple capping devices, also known as capping heads or headsets, for fitting pre-threaded caps onto containers to secure contents disposed inside the containers. A typical capping device includes a drive member operatively coupled to a drive source such as a drive motor or turret assembly. The drive source imparts rotation to the drive member. A capper body rotates with the drive member and slides relative to the drive member. A cap-engaging portion mounts to a bottom of the capper body via a torque dependent clutch such that when the capping device moves downwardly to engage a cap to thread onto a container, the clutch limits the amount of torque transmitted to the cap.

A spring acts between the capper body and the drive member to "soften" the impact of the capping device on the cap. In other words, the spring absorbs the impact of the downward motion of the capping device as the cap-engaging portion contacts the cap to thread the cap onto the container. Otherwise, the cap may not properly fit on the container. In some systems a biasing force provided by the spring, which slidably biases the capper body away from the drive member, is adjustable to adjust an axial force that ultimately acts on the caps. To ensure proper tuning of the biasing force, and provide consistent capping results, the capper body should slide freely relative to the drive member. Typically, the capper body includes a single shaft that slides within a bore in the drive member. Examples of such capping devices are shown in: U.S. Pat. No. 4,295,320 to Willingham; U.S. Pat. No. 4,254,603 to Obrist; and U.S. Pat. No. 6,240,678 to Spether. However, with this configuration, there is a chance that the shaft will bind up in the drive member and prevent uniform sliding movement. This could result in difficulty with processing lines and inconsistent capping results. To ensure that the capper body freely slides relative to the drive member, and to provide consistency in processing, there is a need in the art for an improved bearing mechanism disposed between the drive member and the capper body.

SUMMARY OF THE INVENTION AND ADVANTAGES

The present invention provides a capping device for fitting caps onto containers by applying an axial force to the caps as they are threaded onto the containers. The capping device includes a drive member for rotating about an operational axis. A capper body is slidably coupled to the drive member, but rotatably fixed to the drive member. A biasing member urges the capper body away from the drive member with a biasing force. A bearing mechanism is disposed between the drive member and the capper body for allowing relative sliding movement between the drive member and the capper body while preventing relative rotational movement between the drive member and the capper body. The bearing mechanism includes a plurality of bearing members secured between the drive member and the capper body for allowing free sliding movement between the drive member and the capper body.

By utilizing the plurality of bearing members between the drive member and the capper body, the capper body freely slides relative to the drive member without concern with significant binding against the drive member. With this configuration, the capping device has uniform sliding movement that is reproducible to provide desired capping results.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
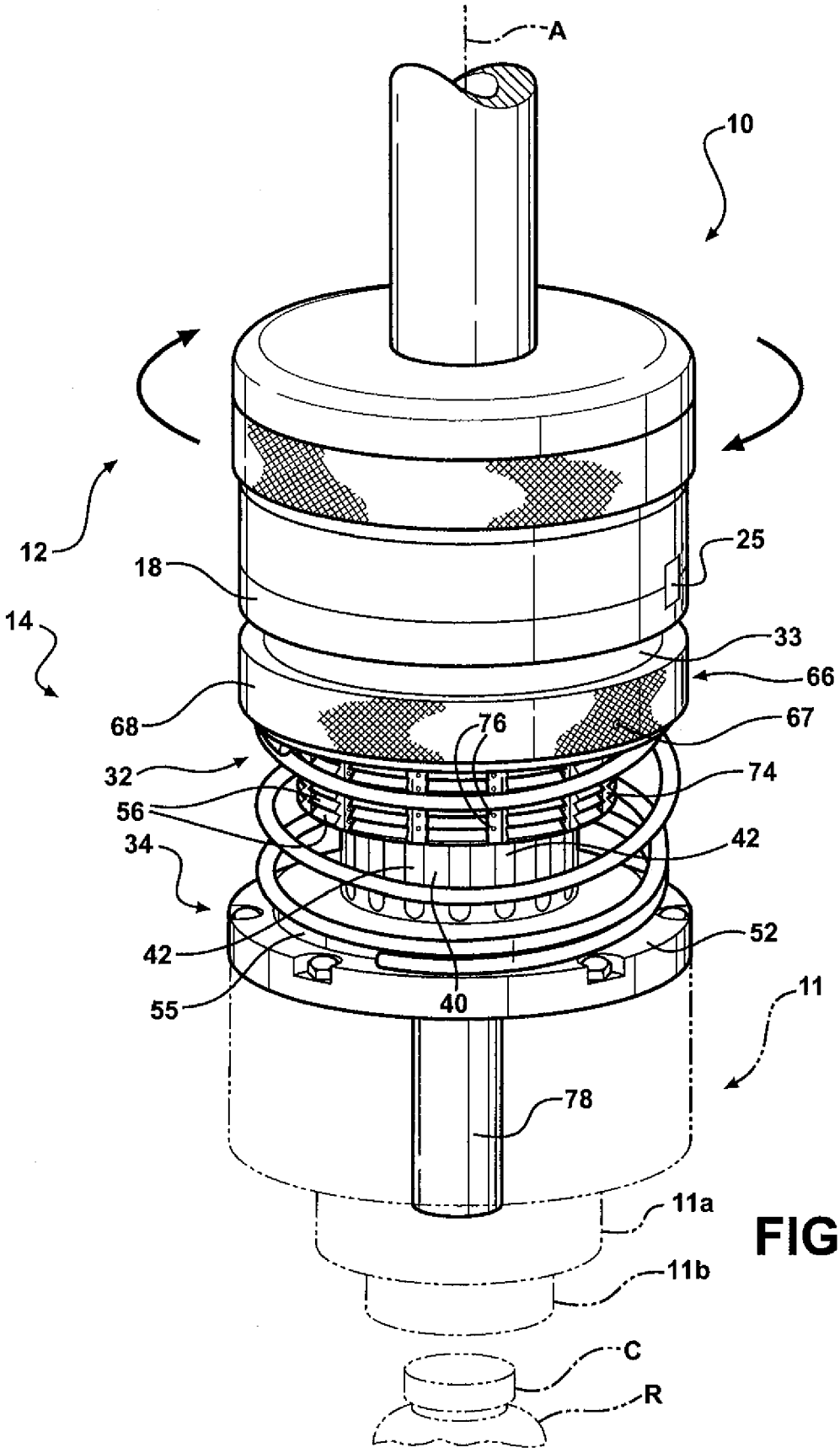
FIG. 1 is a perspective view of a capping device.
Figure 2:
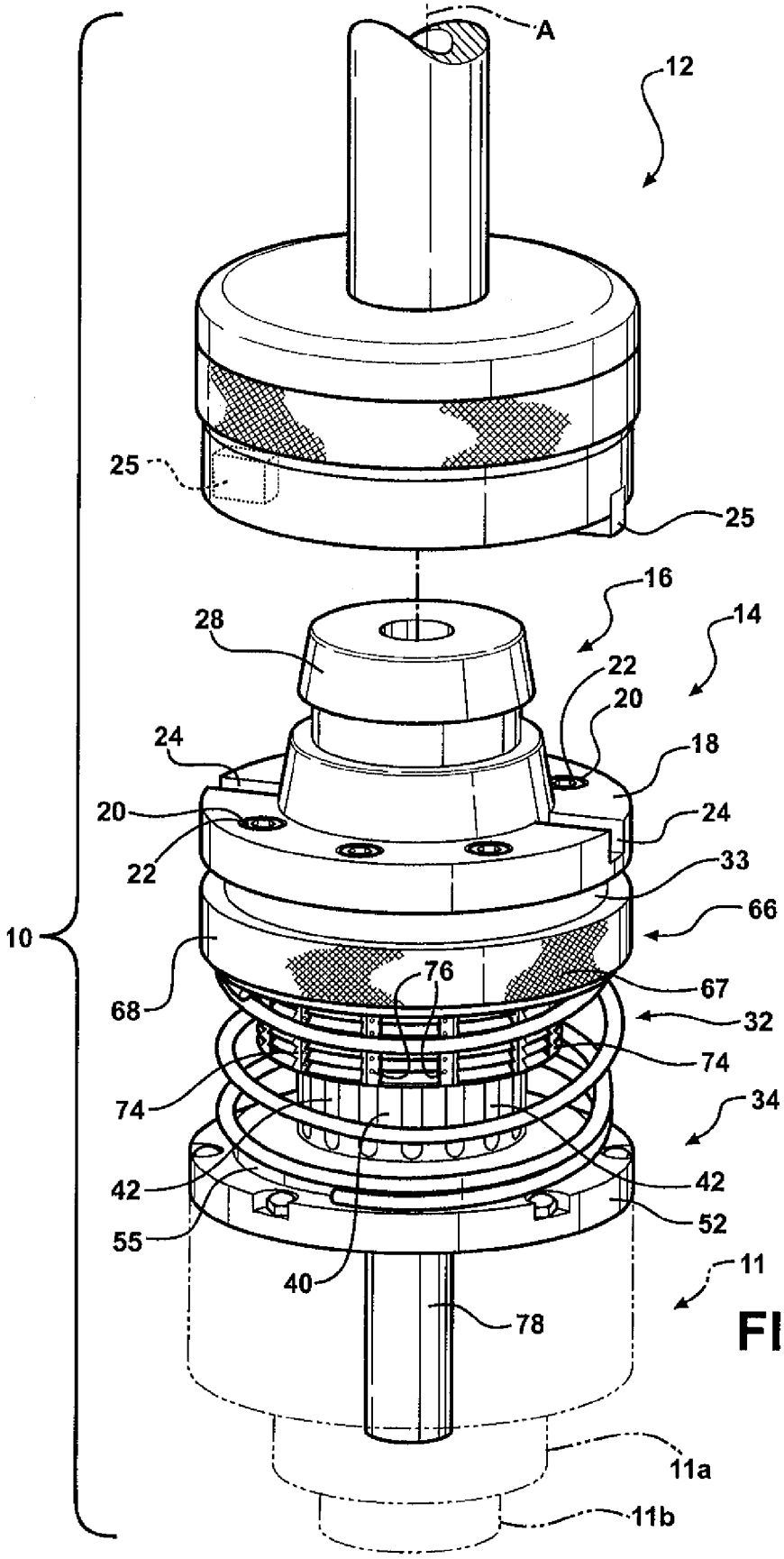
FIG. 2 is another perspective view of the capping device with an upper portion being spaced from a lower portion.

Referring to the Figures wherein like numerals indicate like or corresponding parts throughout the several views, a capping device is generally shown at 10 in FIGS. 1 and 2. The capping device 10 includes an upper portion 12 and a lower portion 14. As discussed in greater detail below, the upper portion 12 mounts to a capping machine (not shown), which imparts rotation to the capping device 10 about an operational axis A via a drive motor, turret assembly, or other drive source. The lower portion 14 has a capping unit 11 (shown in phantom) mounted at a lower end thereof. The capping unit 11 may comprise a clutch 11*a* and a cap-engaging portion 11*b* such as disclosed in U.S. Pat. No. 6,240,678, hereby incorporated by reference. The rotation of the capping device 10 ultimately provides torque to the cap-engaging portion 11*b* in a conventional manner to thread pre-threaded caps C onto containers R as the containers R and the caps C pass through the capping machine. The capping device 10 simultaneously applies an axial force to the caps C and threads the caps C onto the containers R.

Referring to FIGS. 1 and 2, the lower portion 14 of the capping device 10 is removable from the upper portion 12 for servicing and/or for changing the type of capping unit 11 for different applications. The lower portion 14 of the capping device 10 shall be described in detail below. A detailed description of the upper portion 12 and the manner in which the lower portion 14 quickly connects and disconnects from the upper portion 12 is described and claimed in copending U.S. application Ser. No. 11/538,715, filed on Oct. 4, 2006, now U.S. Pat. No. 7,331,157, hereby incorporated by reference.

Figure 3:
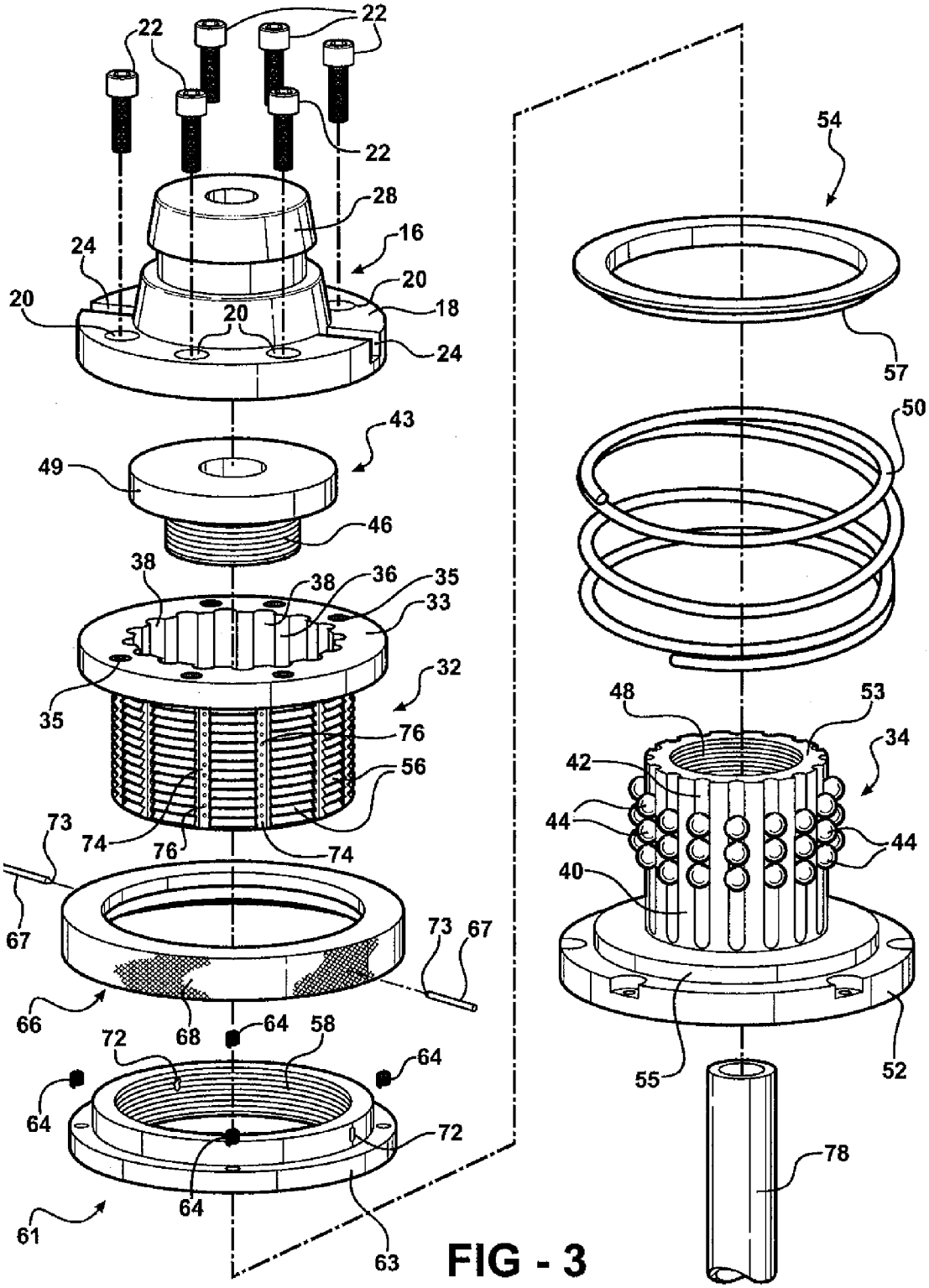
FIG. 3 is an exploded perspective view of the capping device of FIG. 1.

Referring to FIGS. 2 and 3, the lower portion 14 of the capping device 10 includes a connector 16 for inserting into the upper portion 12 to connect the lower portion 14 to the upper portion 12. The connector 16 has a base flange 18 defining a plurality of openings 20 and a pair of channels 24. Drive keys 25, which are fixed to the upper portion 12, fit snugly within the channels 24 when the lower portion 14 is connected to the upper portion 12. The drive keys 25 transfer rotation from the upper portion 12 to the lower portion 14. A tapered body 28 is disposed on the base flange 18 and extends upwardly from the base flange 18 for engaging the upper portion 12, as further described in the copending application hereby incorporated by reference.

Figure 4:
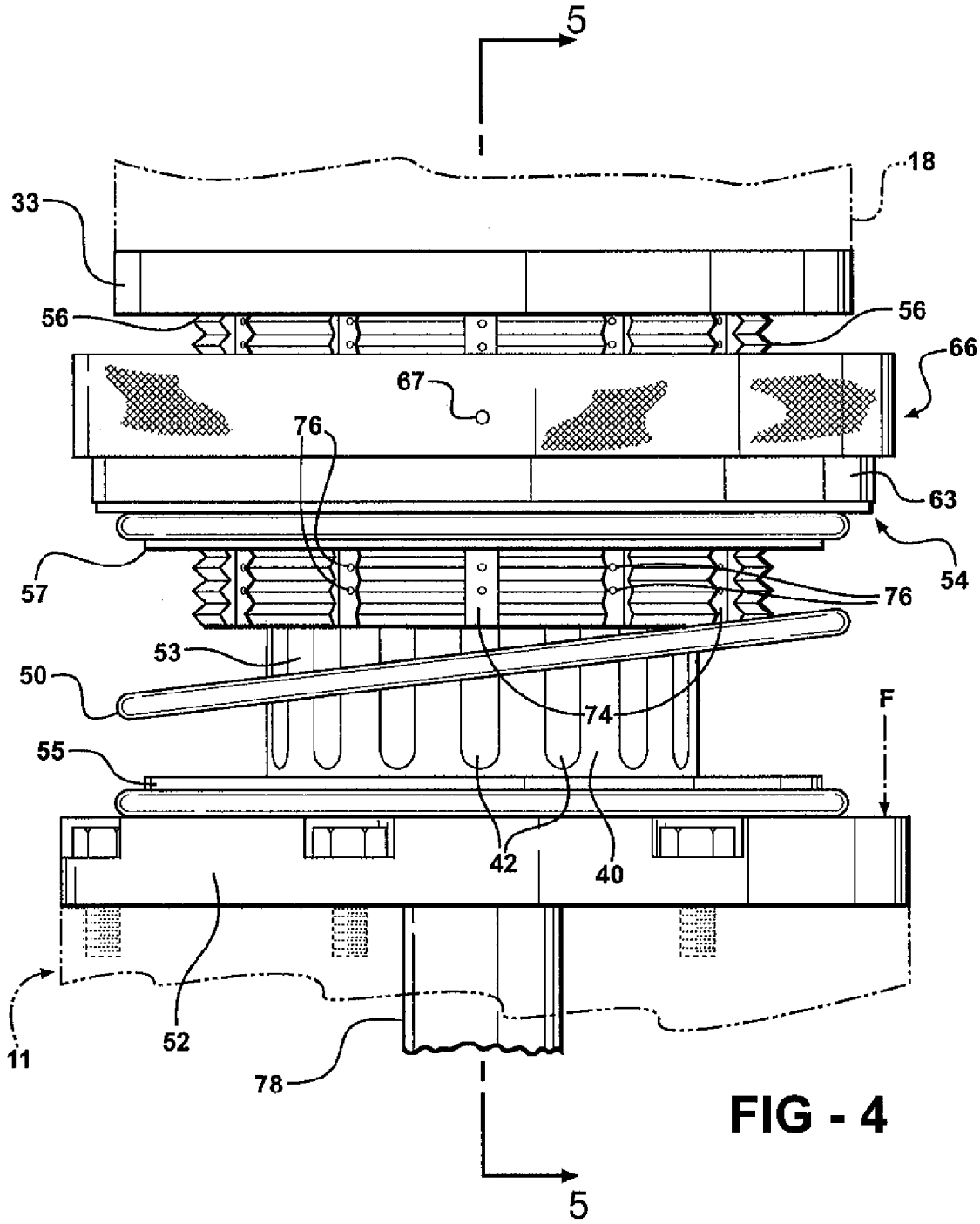
FIG. 4 is a partial side view of the lower portion of the capping device.
Figure 5:
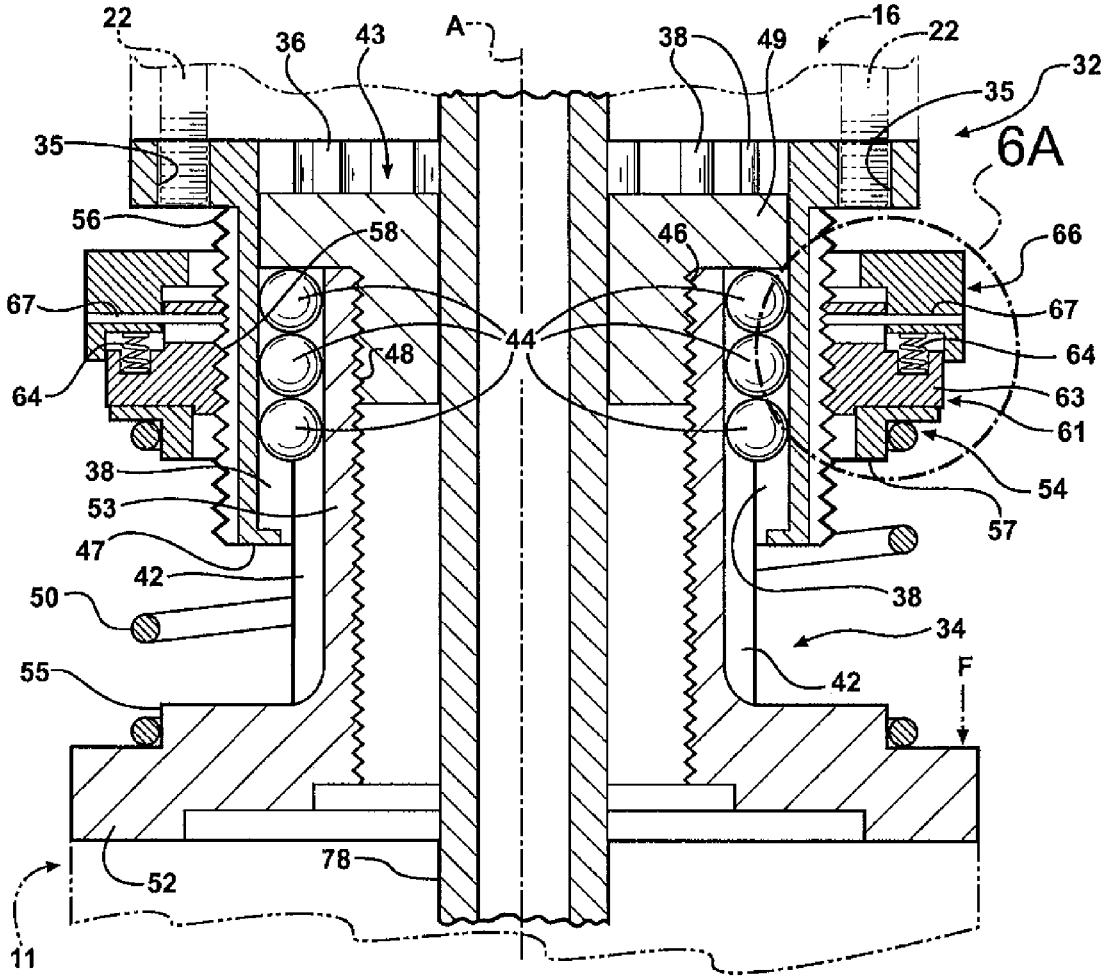
FIG. 5 is a cross-sectional view of the lower portion of the capping device taken along the line 5-5 in FIG. 4.

Referring to FIGS. 3-5, a drive member 32 having a cylindrical shape mounts to the connector 16. In the embodiment shown in FIGS. 3-5, the drive member 32 is further defined as a drive sleeve 32. The drive sleeve 32 has an upper flange 33 with a plurality of openings 35. Fasteners 22 insert through the openings 20 in the base flange 18 and the openings 35 in the upper flange 33 to fix the drive sleeve 32 to the connector 16. Thus, when the upper portion 12 rotates about the operational axis A and imparts rotation to the connector 16 via the drive keys 25, the drive sleeve 32 also rotates with the connector 16.

A capper body 34 is slidably coupled to the drive sleeve 32 and rotatably fixed to the drive sleeve 32 such that the capper body 34 slides relative to the drive sleeve 32 along the operational axis A during use and rotates with the drive sleeve 32 about the operational axis A during use. The capper body 34 includes a connector flange 52 for attaching the capping unit 11 (shown in phantom in FIGS. 1 and 2) in a conventional manner. An inner sleeve 53 having a cylindrical shape extends upwardly from the connector flange 52 to inside the drive sleeve 32 (see FIG. 5).

A bearing mechanism acts between the inner sleeve 53 and the drive sleeve 32 to provide the relative sliding movement and fixed rotational movement between the capper body 34 and the drive sleeve 32. The bearing mechanism includes a plurality of inner bearing grooves 38 defined on an inner surface 36 of the drive sleeve 32, parallel to the operational axis A. Likewise, the bearing mechanism includes a plurality of complimentary outer bearing grooves 42 defined on an outer surface 40 of the capper body 34. The outer grooves 42 align with the inner grooves 38 parallel to the operational axis A. Both the inner 38 and outer 42 grooves are generally U-shaped.

The bearing mechanism further includes bearing members in the form of ball bearings 44 captured between the inner 38 and outer 42 grooves. The grooves 38, 42 and ball bearings 44 allow the capper body 34 to slide smoothly upwardly and downwardly along the operational axis A relative to the drive sleeve 32. At the same time, the ball bearings 44 prevent relative rotation between the drive sleeve 32 and the capper body 34. Thus, the drive sleeve 32 acts as a rotational drive member for rotating the capper body 34 about the operational axis A. Preferably, there are at least three sets of inner 38 and outer 42 bearing grooves with the ball bearings 44 located therebetween. In one embodiment, sixteen sets of inner 38 and outer 42 bearing grooves are employed with four ball bearings 44 falling within each set of grooves 38, 42. In this embodiment, the ball bearings 44 are less than one-quarter inch in diameter. Preferably, the grooves 38, 42 have a depth equal to about one-half a diameter of the ball bearings 44.

A retainer 43 is disposed inside the drive sleeve 32 to engage the capper body 34. The retainer 43 includes threads 46 on an outer surface thereof configured to engage threads 48 disposed on an inner surface of the inner sleeve 53 of the capper body 34. An upper rim 49 of the retainer 43 retains the ball bearings 44 within the bearing grooves 38, 42 at one end. Similarly, the drive sleeve 32 includes a lower rim 47 (see FIG. 5) that retains the ball bearings 44 at an opposite end. Although not shown, the upper rim of the retainer 43 may include an opening for receiving a fastener to secure the retainer 43 to a top of the inner sleeve 53 of the capper body 34. Referring briefly to the exploded view of FIG. 3, the ball bearings 44 are shown suspended in the outer bearing grooves 42. It should be appreciated that this is for illustrative purposes only. During actual assembly, the drive sleeve 32 is first slid over the capper body 34 and the grooves 38, 42 are aligned. Then, with the grooves 38, 42 aligned, the ball bearings 44 are disposed in the corresponding pairs of grooves 38, 42 and captured between the lower rim 47 and the upper rim 49.

A knock out guide tube 78 extends through the drive sleeve 32 and the capper body 34 in the lower portion 14. The tube 78 is used to receive a knock-out rod (not shown) for purposes of expelling unneeded or jammed caps from the capping unit 11 as is well known to those skilled in the art and will not be described in detail.

A biasing member 50 is disposed between the drive sleeve 32 and the capper body 34 to urge the capper body 34 away from the drive sleeve 32 with a biasing force F (see FIG. 5). The biasing member 50 is preferably a helical spring 50 disposed on the base flange 52 of the capper body 34 about an annular step 55. A bellow spring (not shown) could replace the helical spring 50. As shown, a spring washer 54 with a downwardly extending collar portion 57 is disposed on top of the helical spring 50 with the collar portion 57 fitting inside the helical spring 50. The helical spring 50 provides the axial force ultimately applied by the capping unit 11 on the caps C as they thread onto the containers R.

Referring specifically to FIG. 5, an adjustment mechanism is operatively coupled to the helical spring 50 to adjust the biasing force F acting on the capper body 34 thereby adjusting the axial force applied to the caps C as they are threaded onto the containers R by the selected capping unit 11. The adjustment mechanism includes outer threads 56 disposed on an outer surface of the drive sleeve 32. The adjustment mechanism further includes a collar 61 having an inner surface with inner threads 58 for mating with the outer threads 56 of the drive sleeve 32. A user rotates the collar 61 relative to the drive sleeve 32 between a plurality of adjustment positions to raise or lower the collar 61 along the drive sleeve 32. As a result, since the helical spring 50 constantly presses the spring washer 54 against a flange 63 of the collar 61, this movement compresses or decompresses the helical spring 50. This adjusts the biasing force F provided by the helical spring 50.

During operation, the collar 61 could vibrate or otherwise become dislodged from the desired adjustment position and begin to rotate upward to release the helical spring 50 and decrease the biasing force F. In order to prevent this from occurring, a retaining mechanism is operatively coupled to the adjustment mechanism to limit adjustment of the biasing force F. The retaining mechanism includes a pair of locking elements 67 movable between a latched position to prevent adjustment of the biasing force F and an unlatched position to allow adjustment of the biasing force F. The locking elements 67 are further defined as retaining pins 67. The retaining mechanism further includes a series of vertical channels 74 defined in the outer surface 40 of the drive sleeve 32, parallel to the operational axis A, for receiving the retaining pins 67 in the latched position. The vertical channels 74 operate as a plurality of discrete and spaced catches for the retaining pins 67.

A gripping sleeve 66 is fixed to the retaining pins 67 to move the retaining pins 67 between the latched and the unlatched positions. More specifically, the retaining pins 67 interconnect the gripping sleeve 66 and the collar 61. In this embodiment, each of the retaining pins 67 includes a first end fixed to the gripping sleeve 66 in a press-fit manner and a second, tapered end extending into elongated slots 72 defined in the collar 61. The slots 72 penetrate through the inner threads 58 of the collar 61. The tapered ends of the retaining pins 67 are shaped to align with the inner threads 58 of the collar 61 when the retaining pins 67 are in the unlatched position. More specifically, the tapered ends include a tapered section 73 matching the shape of the inner threads 58. In one embodiment, the tapered section 73 includes a 60-degree taper to match a 60-degree taper of the inner threads 58.

Figure 6A:
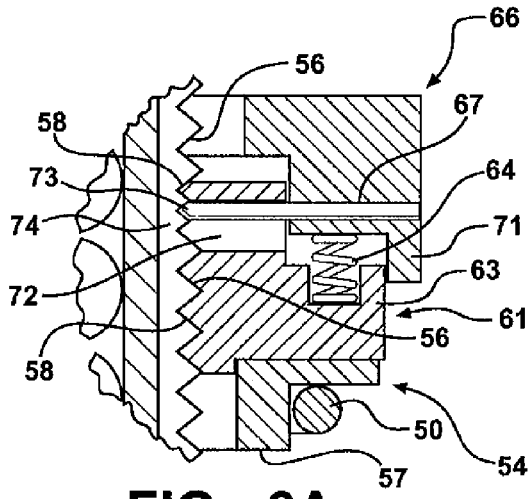
FIG. 6A is a blown-up cross-sectional view of a retaining mechanism and adjustment mechanism of the lower portion from FIG. 5 with the retaining mechanism shown in the latched position.

Referring to FIG. 6A, the retaining pins 67 protrude through the slots 72 out of alignment with the inner threads 58 of the collar 61 in the latched position. Here, the second ends of the retaining pins 67 are disposed in one of the vertical channels 74. Since the second ends of the retaining pins 67 do not align with the inner threads 58 in this latched position, the collar 61 cannot rotate relative to the drive sleeve 32. In other words, the second ends of the retaining pins 67 abut the outer threads 56 of the drive sleeve 32 in either rotational direction. Thus, the retaining pins 67 cannot move out from the vertical channel 74. This is the normal position of the retaining pins 67.

Figure 6B:
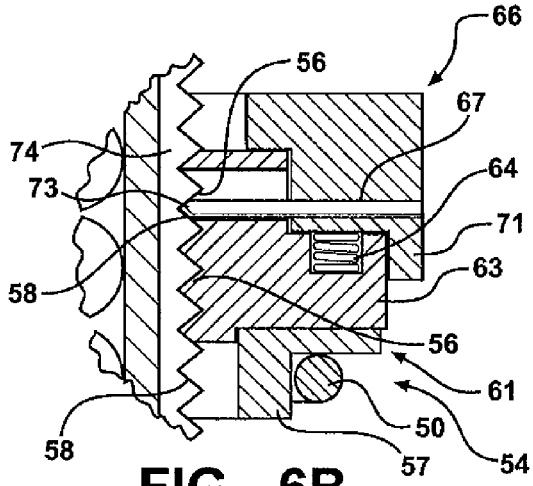
FIG. 6B is a blown-up cross-sectional view of the retaining mechanism and the adjustment mechanism of the lower portion from FIG. 5 with the retaining mechanism shown in the unlatched position.
Figure 7:
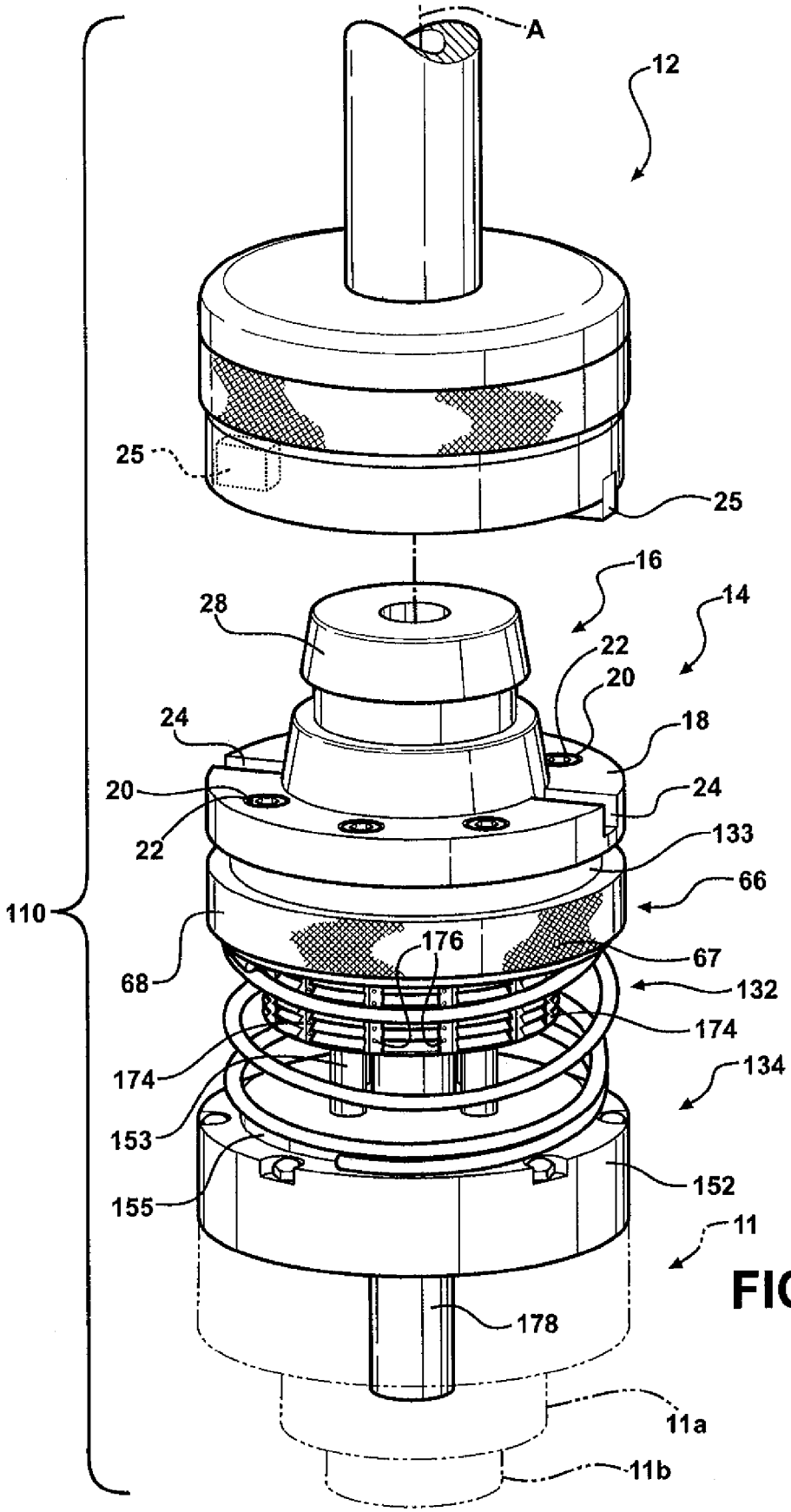
FIG. 7 is a perspective view of the capping device with an alternative bearing mechanism.
Figure 8:
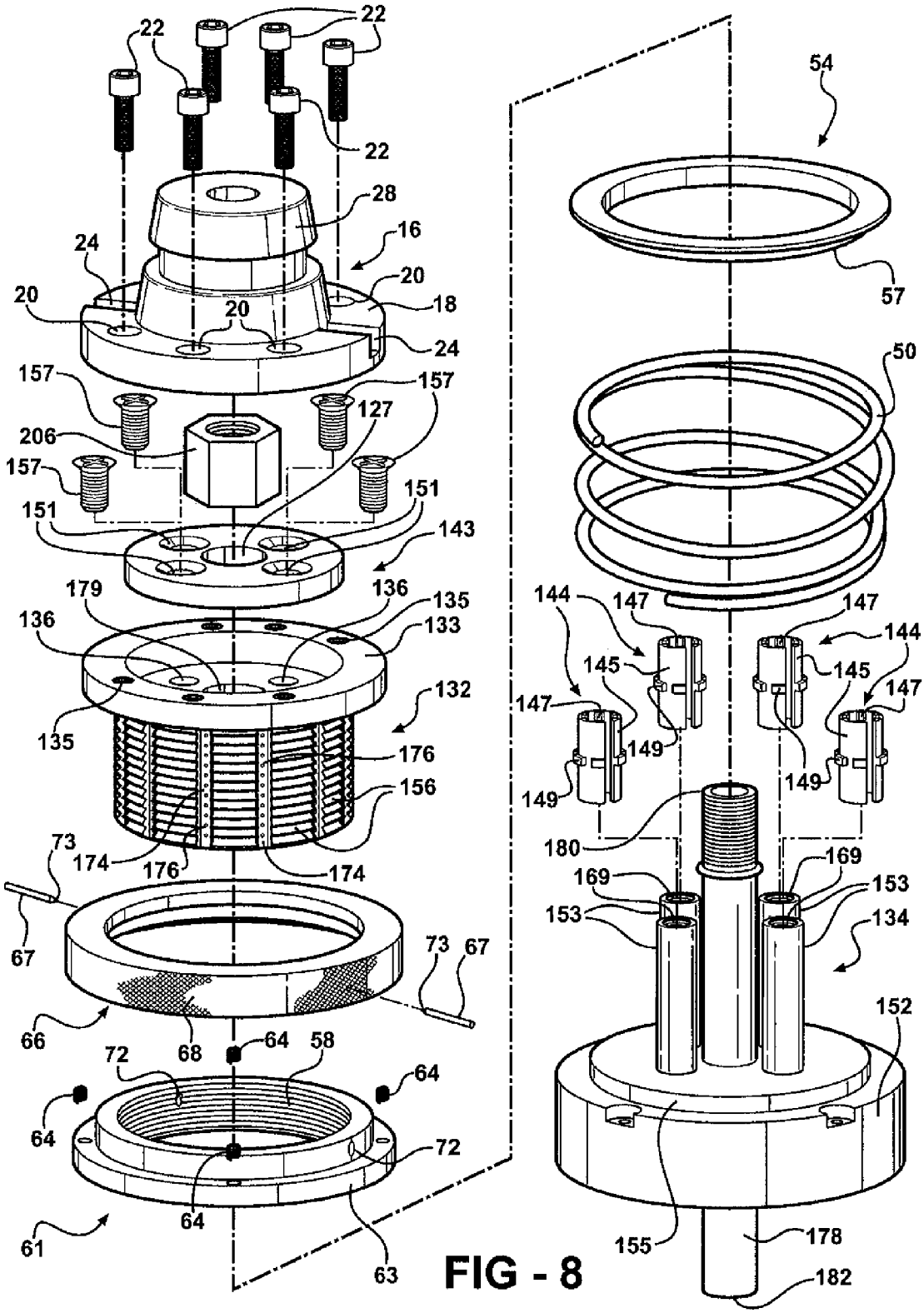
FIG. 8 is an exploded perspective view of the capping device of FIG. 7.
Figure 9:
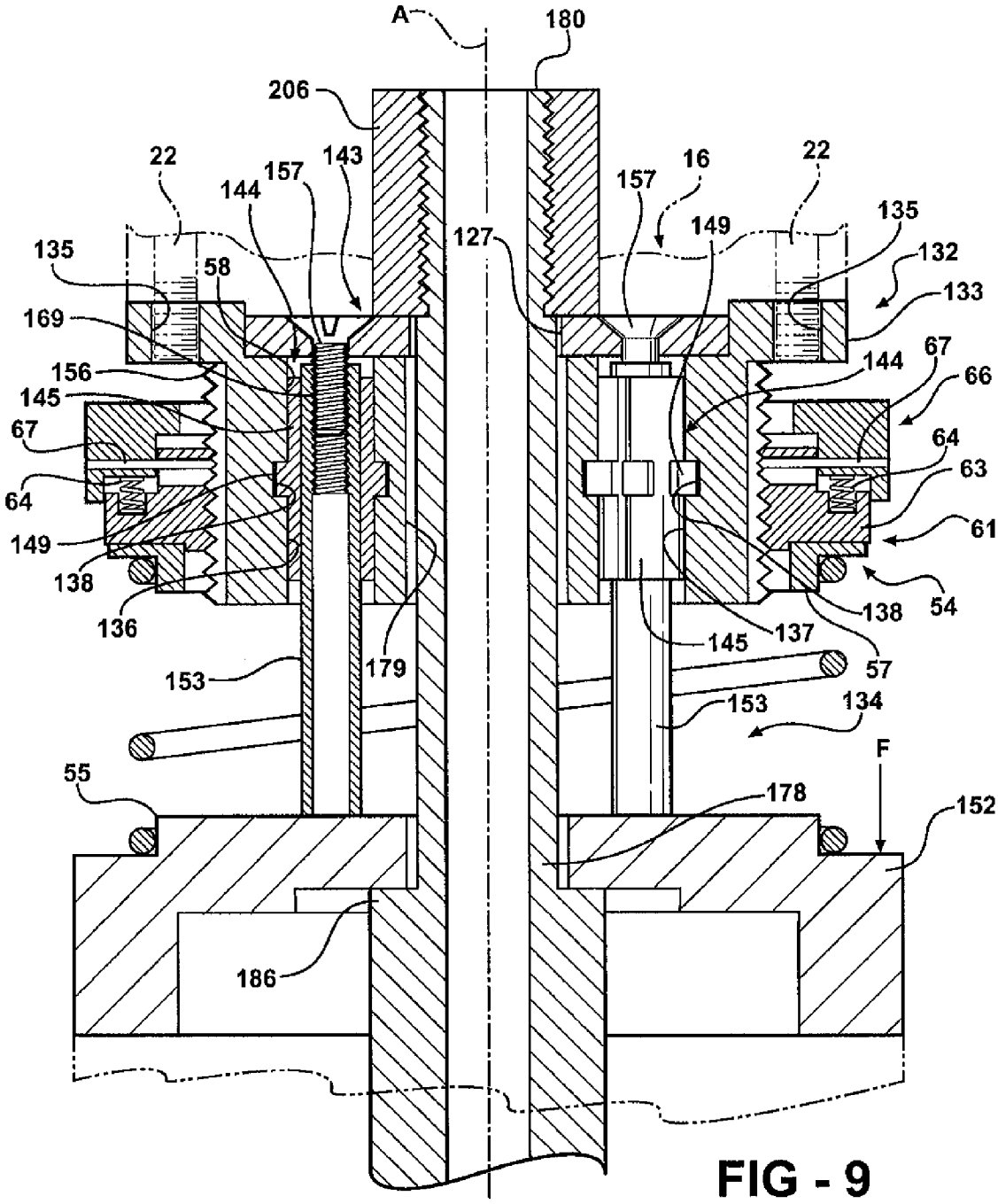
FIG. 9 is a cross-sectional view of the lower portion of the capping device of FIG. 7.

Referring to FIG. 6B, gripping sleeve 66 has been moved downwardly such that the retaining pins 67 protrude through the slots 72 in alignment with the inner threads 58 of the collar 61. This is the unlatched position of the retaining pins 67. Now, the second ends of the retaining pins 67 are aligned with the inner threads 58 to mate with the outer threads 56 of the drive sleeve 32. Thus, the collar 61 can be rotated between the plurality of adjustment positions to adjust the biasing force F.

A plurality of biasing components 64, further defined as compression springs 64, are circumferentially spaced in recesses along the flange 63 of the collar 61 to bias the gripping sleeve 66 upwardly away from the flange 63 to normally place the retaining pins 67 in the latched position and prevent inadvertent adjustment of the biasing force F during use. The gripping sleeve 66, which includes a textured outer surface 68 for grasping by a user, includes a lip 71 that extends downwardly beyond the collar 61 to conceal the compression springs 64.

During use, the user pulls downwardly on the gripping sleeve 66 which pulls the retainer pins 67 to a bottom of the slots 72 in the collar 61 (see FIG. 6B). The tapered sections 73 of the retaining pins 67 are thereby aligned with the inner threads 58 such that the retaining pins 67 can move through the outer threads 56 to rotate the collar 61 relative to the drive sleeve 32 to compress or decompress the helical spring 50. Once the desired adjustment position of the collar 61 is found, the user releases the gripping sleeve 66. If the retaining pins 67 are not already aligned in one of the vertical channels 74, further rotation of the collar 61 in either direction will automatically position the retaining pins 67 in the next available channel 74. Once the retaining pins 67 are in a vertical channel 74, the compression springs 64 automatically bias the gripping sleeve 66 upwardly and return the retaining pins 67 to a top of the slots 72 in the collar 61 in the latched position (see FIG. 6A). A height of the slots 72 in the collar 61 is equal to one-half the pitch distance of the inner threads 58. Hence, the retaining pins 67, which remain in the appropriate vertical channel 74, are now aligned with a crest of the outer threads 56, as shown in FIG. 6A, such that further rotation of the collar 61 in either direction is prevented.

Referring back to FIGS. 3 and 4, a series of visual markings or markers 76 are disposed on the outer surface 40 of the drive sleeve 32 in at least a few, if not all, of the vertical channels 74 to indicate the amount of the biasing force F, i.e., compression force, such as in pounds, provided by the helical spring 50 so that a user can determine the change in the biasing force F that is made when the biasing force F is adjusted.

Preferably, each of the above-described components are formed of metal or metal alloys such as stainless steel, aluminum, and the like. Other suitable materials may also be used to form these components.

FIGS. 7-10 illustrate an alternative bearing mechanism. Like parts from the previously described bearing mechanism have been labeled with numerals indexed by 100, unless otherwise indicated. In this embodiment, the drive member is further defined as a drive body 132. The drive body 132 has a cylindrical shape and mounts to the connector 16 in the same manner as the previously described drive sleeve 32. As with the drive sleeve 32, the drive body 132 has an upper flange 133 with a plurality of openings 135. Fasteners 22 insert through the openings 20 in the base flange 18 and the openings 135 in the upper flange 133 to fix the drive body 132 to the connector 16. Thus, when the upper portion 12 rotates about the operational axis A and imparts rotation to the connector 16 via the drive keys 25, the drive body 132 also rotates with the connector 16.

An alternative capper body 134 is slidably coupled to the drive body 132 and rotatably fixed to the drive body 132 such that the alternative capper body 134 slides relative to the drive body 132 along the operational axis A during use and rotates with the drive body 132 about the operational axis A during use. The alternative capper body 134 includes a connector flange 152 for attaching the capping unit 11 (shown in phantom in FIG. 7) in a conventional manner.

The alternative bearing mechanism acts between the alternative capper body 134 and the drive body 132 to provide the relative sliding movement and fixed rotational movement between the alternative capper body 134 and the drive body 132. The alternative bearing mechanism includes a plurality of bearing shafts 153 fixed to the connector flange 152. The shafts 153 are fixed by welding to the connector flange 152, press-fit into openings in the connector flange 152, or the like. Each of the shafts 153 has a cylindrical shape and extends upwardly from the connector flange 152. The shafts 153 include threaded bores 169 at a first end for receiving threaded fasteners 157, for purposes described further below. The alternative bearing mechanism further includes a plurality of bores 136 defined through the drive body 132.

Figure 10:
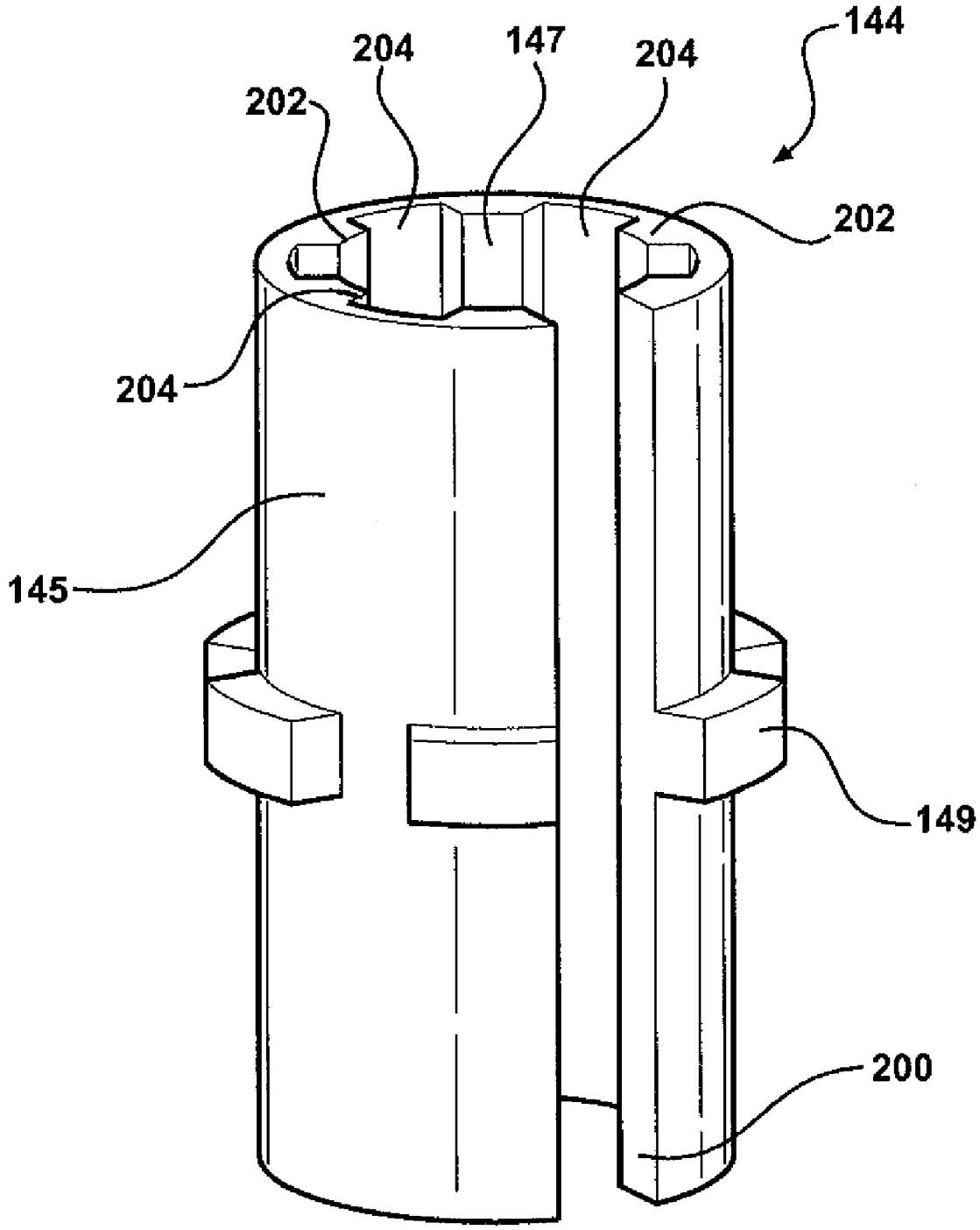
FIG. 10 is a perspective view of a bushing used with the capping device of FIG. 7.

The alternative bearing mechanism also includes bearing members in the form of bushings 144. Each of the bushings 144 includes a generally annular and cylindrical body 145 defining a through bore 147 sized and shaped to slidably receive the shafts 153. Referring to FIG. 10, each of the bushings 144 has an elongated opening 200 that splits the body 145. The bushings 144 are preferably formed from a plastic material such that they are flexible and capable of being compressed in diameter. The bushings 144 are preferably supplied from Igus GmbH of Germany, more preferably part no. JUI-06. Similar bushings that may be used are shown in U.S. Pat. No. 6,113,275 to Blase, hereby incorporated by reference.

Each of the bushings 144 includes a flange portion 149 having a larger diameter than the rest of the body 145. The flange portion 149 is located generally halfway along the body 145 to split the body in equal upper and lower parts. The flange portion 149 is sized and shaped for being captured in an annular cavity or groove 138 defined in the bores 136. During assembly, the bushings 144 are compressed via their elongated opening 200 to a smaller diameter than that of the bores 136 and are then allowed to open under their normal springing bias back to their original diameter with the flange portions 149 being seated and retained in the annular grooves 138. In some embodiments, each of the bushings 144 include a plurality of spaced flange portions 149, while in other embodiments (not shown), the flange portion is continuous about the body 145 (except at the elongated opening 200).

The bushings 144 include alternating ribs 202 and channels 204 that continue the entire length of the body 145. With this configuration, when the shafts 153 are inserted into the bushings 144, the shafts 153 only contact the ribs 202. The ribs 202 define the surface that contacts the shafts 153. The channels 204 are designed to receive any foreign particles and to allow the bushings 144 to react to expansion of the shafts 153 when the shafts 153 become heated during use. Should the shafts 153 expand, the ribs 202 compress and occupy part of the space available in the channels 204. The shafts 153 continue to slide smoothly upwardly and downwardly along the ribs 202 in the bushings 144.

By using multiple shafts 153, relative rotation between the drive body 132 and the alternative capper body 134 is prevented. Thus, the drive body 132 acts as a rotational drive member for rotating the alternative capper body 134 about the operational axis A. Preferably, there are at least four sets of shafts 153, bushings 144, bores 136, and grooves 138. For purposes of illustration, the cross-sectional view of FIG. 9, even though cut along the operational axis A, illustrates one set of the shafts 153 and bushings 144 as being whole, and not sectioned.

A retainer plate 143 is movably seated in a cavity defined in an upper end of the drive body 132 over the bores 136. The retainer plate 143 includes a plurality of openings for receiving the threaded fasteners 157 to secure the retainer plate 143 to the shafts 153. The retainer plate 143 is adapted to move with the shafts 153 relative to the drive body 132. The retainer plate 143 further defines a central opening 127 for receiving a knock-out tube guide 178. The guide 178 has a first end 180 and a second end 182. In this embodiment, the first end 180 is threaded. The guide 178 freely slides in the drive body 132 through a central bore 179 defined through the drive body 132.

A nut 206 threads onto the first end 180 of the guide 178. The nut 206 further secures the retainer plate 143 in position and prevents the guide 178 from falling through the central bore 179. The guide 178 further includes an enlarged shoulder section 186 to prevent the guide 178 from passing through the connector flange 152. The nut 206 and shoulder section 186 secure the connector flange 152 and retainer plate 143 therebetween.

During use, the shafts 153 slide in the through bores 147 of the bushings 144. The bushings 144 are restrained in the grooves 138 of the drive body 132. The retainer plate 143 slides with the shafts 153. Likewise, the guide 178 slides through the central bore 179 during use with the connector flange 152 moving therewith. Thus, the shafts 153, retainer plate 143, threaded fasteners 157, guide 178, nut 206, and connector flange 152 move as a single unit relative to the drive body 132 during use.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. It is intended that the invention not be limited to the particular embodiment disclosed as the best mode contemplated for carrying out this invention, but that the invention will include all embodiments falling within the scope of the appended claims.

What is claimed is:

1. A capping device for fitting caps onto containers, said device comprising:

a drive member rotatable about an operational axis and defining a plurality of bores;

a capper body slidably coupled to said drive member and rotatably fixed to said drive member;

a biasing member urging said capper body away from said drive member with a biasing force; and a bearing mechanism disposed between said drive member and said capper body for allowing relative sliding movement between said drive member and said capper body while preventing relative rotational movement between said drive member and said capper body, said bearing mechanism including a plurality of bushings having a generally annular shape disposed in said bores of said drive member and a plurality of guide shafts fixed to said capper body and slidable within said plurality of bushings.

2. A capping device as set forth in claim 1 wherein each of said plurality of bushings are spaced radially from said operational axis.

3. A capping device as set forth in claim 1 wherein each of said plurality of bushings are spaced circumferentially about said operational axis from one another.

4. A capping device as set forth in claim 1 wherein said plurality of bushings includes three bushings.

5. A capping device as set forth in claim 1 wherein each of said plurality of bushings includes a plurality of ribs defining an inner surface in contact with said guide shafts.

6. A capping device as set forth in claim 5 wherein said ribs are circumferentially spaced and define channels therebetween.

7. A capping device as set forth in claim 1 wherein each of said plurality of bushings includes a flexible body having an elongated opening defined therethrough so that said body is split and able to be compressed in diameter for fitting into said bore in said drive member.

8. A capping device as set forth in claim 7 wherein each of said plurality of bushings includes a flange portion extending radially outwardly from said body and each of said bores of said drive member defines an annular cavity for receiving said flange portion.

* * * * *